US012618217B2

(12) United States Patent
Mathis et al.

(10) Patent No.: US 12,618,217 B2
(45) Date of Patent: May 5, 2026

(54) SUCTION ANCHOR OR WELL SUPPORT FOUNDATION FOR USE IN PERMEABLE WATER BOTTOM FORMATIONS

(71) Applicant: Neodrill AS, Stavanger (NO)

(72) Inventors: Wolfgang Mathis, Sandnes (NO); Ole Kristian Holen, Stavanger (NO)

(73) Assignee: Neodrill AS, Stavanger (NO)

( * ) Notice: Subject to any disclaimer, the term of this patent is extended or adjusted under 35 U.S.C. 154(b) by 129 days.

(21) Appl. No.: 18/329,517

(22) Filed: Jun. 5, 2023

(65) Prior Publication Data

US 2023/0332369 A1 Oct. 19, 2023

Related U.S. Application Data

(63) Continuation of application No. PCT/IB2020/061627, filed on Dec. 8, 2020.

(51) Int. Cl.

| | |
|---|---|
| ***E02D 27/52*** | (2006.01) |
| ***B63B 21/27*** | (2006.01) |
| ***E02D 7/20*** | (2006.01) |
| *E02B 17/00* | (2006.01) |

(52) U.S. Cl.

CPC ..... *E02D 27/525* (2013.01); *B63B 21/27* (2013.01); *E02D 7/20* (2013.01); *E02B 2017/0078* (2013.01)

(58) Field of Classification Search

CPC ... B63B 21/27; E02B 2017/0078; E02D 7/20; E02D 15/08; E02D 23/08; E02D 27/525

USPC ..... 405/224.1; 114/296

See application file for complete search history.

(56) References Cited

U.S. PATENT DOCUMENTS 3,817,040 A * 6/1974 Stevens ..... E02D 7/24 114/295
4,318,641 A * 3/1982 Hogervorst ..... B63B 21/27 405/172
4,432,671 A * 2/1984 Westra ..... B63B 21/27 405/226

(Continued)

FOREIGN PATENT DOCUMENTS

CN 113212655 A * 8/2021 ..... B63B 21/27
CN 114555908 A * 5/2022 ..... E21B 33/035

(Continued)

OTHER PUBLICATIONS

International Search Report, International Application No. PCT/IB2020/061627 dated Sep. 28, 2021.

(Continued)

*Primary Examiner* — Frederick L Lagman
(74) *Attorney, Agent, or Firm* — Richard A. Fagin

(57) ABSTRACT

A suction anchor has a skirt open at one end and closed at another end to define an interior volume. At least one conduit nested within or adjacent to the skirt, is open at one end and closed at another end to define an inner volume. A suction line is fluidly connected to the interior volume through a first valve. A second valve is fluidly connected between the inner volume and either the suction line or the interior volume. The first valve and the second valve are operable to cause water flow at respective selected rates along both the skirt and the conduit from a body of water when the interior volume and the inner volume are evacuated and the suction anchor is disposed on the bottom of a body of water.

20 Claims, 11 Drawing Sheets

(56) References Cited

U.S. PATENT DOCUMENTS 4,575,282 A * 3/1986 Pardue, Sr ..... E02D 5/42 405/195.1
5,704,732 A * 1/1998 Horton, III ..... B63B 21/26 114/296
5,927,904 A * 7/1999 Treu ..... E02D 7/28 114/313
5,992,060 A * 11/1999 Treu ..... B63B 21/26 405/224.1
6,113,315 A * 9/2000 Fulton ..... B63B 21/50 405/224.1
6,692,194 B2 * 2/2004 Strand ..... E21B 33/02 405/226
7,140,319 B2 * 11/2006 Raines ..... B63B 21/27 114/296
7,527,455 B2 * 5/2009 Raines ..... B63B 21/29 405/224.1
7,621,059 B2 * 11/2009 McCoy, Jr. ..... E02F 3/907 37/317
7,661,905 B2 * 2/2010 Alhayari ..... B63B 21/27 405/224.1
7,891,910 B2 * 2/2011 Schakenda ..... E02D 27/52 405/226
8,025,463 B2 * 9/2011 Foo ..... B63B 21/27 405/226
9,789,932 B2 * 10/2017 van Wijk ..... B63B 21/27
10,627,011 B2 * 4/2020 Endal ..... E21B 43/013
11,242,663 B2 * 2/2022 Dingman ..... E02D 5/223
12,077,250 B2 * 9/2024 Reinås ..... E21B 33/035
12,116,748 B2 * 10/2024 Ellingsen ..... E02D 27/525
2012/0003048 A1 1/2012 Hosoey et al.
2020/0071899 A1 * 3/2020 Dingman ..... F16L 55/1125
2022/0063769 A1 * 3/2022 Cotrell ..... B33Y 80/00
2022/0106020 A1 * 4/2022 Damiani ..... B63B 21/27

FOREIGN PATENT DOCUMENTS

KR 20140130804 A * 11/2014
KR 2019 0031868 A 3/2019

OTHER PUBLICATIONS

Written Opinion of the International Search Authority, International Application No. PCT/IB2020/061627 dated Sep. 28, 2021.

* cited by examiner

SUCTION ANCHOR OR WELL SUPPORT FOUNDATION FOR USE IN PERMEABLE WATER BOTTOM FORMATIONS

CROSS REFERENCE TO RELATED APPLICATIONS

Continuation of International Application No. PCT/IB2020/061627 filed on Dec. 8, 2020, which application is incorporated herein by reference in its entirety.

STATEMENT REGARDING FEDERALLY SPONSORED RESEARCH OR DEVELOPMENT

Not Applicable

NAMES OF THE PARTIES TO A JOINT RESEARCH AGREEMENT

Not Applicable.

BACKGROUND

This disclosure relates to the field of water bottom suction anchors. More specifically, the disclosure relates to suction anchors or well supports used in permeable water bottom soils or formations.

Suction anchors known in the art have been installed mostly in clay type formations, which have relatively low permeability. More recently, especially motivated by applications connected to offshore wind farming, suction anchors have also been used as foundations in pure sand and mixed (layered clay-sand) formations, which may be relatively permeable.

FIG. 1 and FIG. 2 show, respectively, a side cross-section view and a top view of a conventional suction anchor 10. The suction anchor 10 consists of a skirt 12, typically having a circular cross-section, and a top 11 that seals the upper longitudinal end of skirt 12. During installation on the water bottom, the tip 17 of the skirt 12 first penetrates sediments on the water bottom due to the weight of the suction anchor 10, creating a semi permeable seal to the water bottom sediments (formation) 3 at the bottom end of skirt 12. To urge the suction anchor 10 further into the formation 3, a suction pump 18 is connected to a suction line 15 that is fluidly connected to an internal water mass 4 within the skirt 12. In the case wherein the formation 3 consists of sand or mixed sand/clay and is therefore permeable, the under-pressure generated inside the suction anchor 10 by evacuating water from the suction line 15 causes water to be displaced from the surrounding body of water 1 external to the skirt 12 into the internal water mass 4 within the suction anchor 10. This is indicated in FIG. 1 by a flow path shown at 20. The under-pressure also generates a downward force by reason of the greater pressure of the water 1 outside the top 11 that pushes the suction anchor 10 further into the formation 3. Additionally, the water flow around the skirt tip 17 causes fluidization of the sand, which reduces resistance to further penetration of the skirt 12 into the sub-bottom.

After reaching the desired penetration depth with the suction anchor 10, it is beneficial if the suction line 15 is sealed, for example using a suction line valve 16 in order to obtain the maximal load capacity of the suction anchor 10.

Conventional suction anchors may have an internal structure, for example an internal support member 13, to increase the load capacity of an anchoring point 14 on the skirt 12, where an anchoring chain or the like may be attached. Such internal structures can increase the penetration resistance during deployment of the suction anchor 10. The penetration resistance may be decreased by the installation of a water injection line to the bottom edge of the internal member 13, in order to fluidize the formation 3, e.g., sand, locally, similar to the fluidization that is caused by water flowing along the flow path 20.

A well support structure, or Conductor Anchor Node system is based on a suction anchor to form the foundation for subsea oil and gas wells, including water, gas, steam, or other fluid injection wells. One such system is sold under the trademark CAN, which is a registered trademark of Neodrill AS, Stavanger, Norway. The CAN system has some differences with respect to a conventional suction anchor. FIGS. 3 and 4 show, respectively, a side cross-section view and a top view of an example CAN system 30. Because the CAN system 30 is used as a well foundation, a conduit 31 is disposed inside the skirt 12 of the structure of a suction anchor. This conduit 31 is attached to a top 11 disposed on the upper end of the skirt 12 in a pressure tight manner. During the well construction process, a sub-bottom well is established through the conduit 31, which supports well components and acts as a guide for well construction tools. The conduit 31 may in some cases be additionally supported by internal members 32 extending between the conduit 31 and the skirt 12. The CAN system 30 also allows the pre-installation of a conduit known as a conductor (a structural casing) or any other wellbore tubular element as discussed further below.

The presence of the conduit 31 causes several complications during the installation process of a CAN system in permeable formation 3, such as sand, sandy clay and interspersed sand and clay. The installation mechanics of a CAN system in permeable formation rely on water being drawn from the surrounding water 1, through the formation 3 along the outer wall of the skirt 12, around the tip 17 of the skirt 12 into the interior of the skirt 12, upward inside the skirt 12 into the internal water mass 4 below the top 11. This is indicated by a flow path shown at 20. From there, the water will be drawn through the suction line 15, by a suction pump 18 and discharged back into the surrounding water mass 1. The water flow around the skirt tip 17 fluidizes the sand, which decreases the penetration resistance of the CAN system 30 into the formation 3. As mentioned above, the CAN system 30 comprises an additional conduit 31 nested in the skirt 12. The conduit 31 provides a second possible flow path which water may traverse during the CAN system installation process. This second possible flow path along the conduit 31 is downward inside of the conduit 31, around the conduit tip 33 and upward into the internal water mass 4. This is indicated as a flow path shown at 34. In practice, it is not possible to predict which flow path (20 or 34) will be traversed by moving water. It can be detrimental to the installation process if the path of least resistance is along flow path 34. In this case only the relatively small circular length of the circumference of conduit 31, at the tip 33, will experience fluidization, whereas the larger circular length of circumference of the skirt 12, at the tip 17, will experience no fluidization. This may minimize the reduction of the total resistance to movement formed by the sum of tip area of the skirt tip 17 and the conduit tip 33, and as a result the installation of the CAN system 30 to the target depth may fail.

SUMMARY

One aspect of the present disclosure relates to a suction anchor. A suction anchor according to this aspect of the disclosure has a skirt open at one end and closed at another end to define an interior volume. A conduit is nested within the skirt or is adjacent to the skirt. The conduit is open at one end and is closed at another end to define an inner volume. A suction line is fluidly connected to the interior volume through a first valve. A second valve is fluidly connected between the inner volume and either the suction line or the interior volume. The first valve and the second valve are operable to cause water flow at respective selected rates along both the skirt and the conduit from a body of water when the interior volume and the inner volume are evacuated and the suction anchor is disposed on the bottom of a body of water. At least one of the first valve and the second valve has a variable orifice.

Some embodiments further comprise a conductor nested within the conduit. The conductor comprises a wellhead housing and a conductor pipe extending from the wellhead housing through the conduit.

In some embodiments, the conduit and the conductor pipe are connected at respective longitudinal ends by a conductor anchor.

In some embodiments, the inner volume is defined within an interior of the conductor pipe.

In some embodiments, the cap comprises a conductor running tool disposed in the conductor pipe.

Some embodiments further comprise a pressure sensor in fluid communication with the inner volume and the interior volume, the pressure sensor arranged to generate signals corresponding to a difference between fluid pressure in the inner volume and fluid pressure in the interior volume.

In some embodiments, the second valve is in fluid communication between the inner volume and the interior volume.

In some embodiments, the second valve is in fluid communication between the inner volume and the suction line.

In some embodiments, at least one of the first valve and the second valve has a variable orifice.

A method for affixing a suction anchor having a conduit nested in or adjacent to the suction anchor to the bottom of a body of water according to another aspect includes lowering the suction anchor so that a skirt is in contact with the bottom of the body of water. Pressure is reduced in an interior volume defined within the skirt and external to the conduit. Pressure is reduced in an inner volume defined by the interior of the conduit. The reducing pressure in the inner volume and the reducing pressure in the interior volume are performed at respective rates such that water cross flow between the interior volume and the inner volume is minimized.

In some embodiments, the respective rates are controlled by operating at least one variable flow valve.

A suction anchor according to another aspect of this disclosure comprises a skirt open at one end and closed at another end to define an interior volume. At least one conduit is nested within the skirt or disposed adjacent to the skirt, the conduit open at one end and temporarily closed at another end to define an inner volume. Means for evacuating the inner volume and the internal volume is operable to cause water flow along both the skirt and the conduit from a body of water by separately controlling rates of evacuation from the inner volume and the internal volume when the suction anchor is disposed on the bottom of a body of water.

Some embodiments further comprise a conductor nested within the conduit, the conductor comprising a wellhead housing and a conductor pipe extending from the wellhead housing through the conduit.

In some embodiments, the conduit and the conductor pipe are connected at respective longitudinal ends by a conductor anchor.

In some embodiments, the inner volume is defined within an interior of the conductor pipe.

In some embodiments, the cap comprises a conductor running tool temporarily disposed in the conductor pipe.

Some embodiments further comprise a pressure sensor in fluid communication with the inner volume and the interior volume, the pressure sensor arranged to generate signals corresponding to a difference between fluid pressure in the inner volume and fluid pressure in the interior volume.

In some embodiments, the means for evacuating comprises a pump, a first valve in fluid communication between an inlet of the pump and the internal volume and second valve in fluid communication between the inner volume and the interior volume.

In some embodiments, the second valve is in fluid communication between the inner volume and the inlet of the pump.

In some embodiments, at least one of the first valve and the second valve has a variable orifice.

In some embodiments, the means for evacuating comprises a first pump having an inlet in fluid communication with the inner volume and a second pump having an inlet in fluid communication with the internal volume.

In some embodiments, at least one of the first pump and the second pump is a variable speed pump.

Other aspects and possible advantages will be apparent from the description and claims that follow.

DETAILED DESCRIPTION

Figure 3:
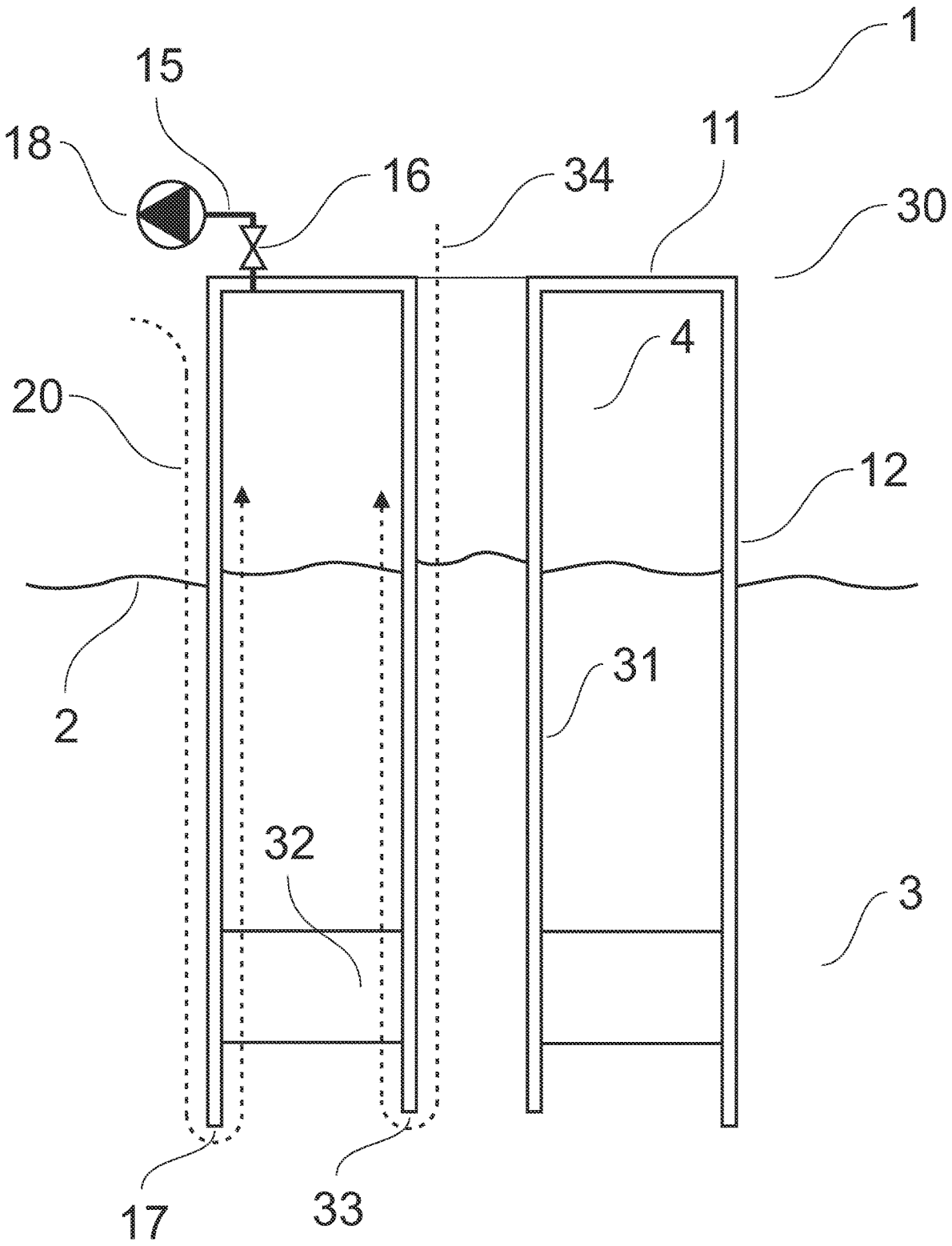
FIG. 3 (PRIOR ART)
FIG. 3 shows an elevation view of a well support foundation known in the art prior to the present disclosure.
Figure 4:
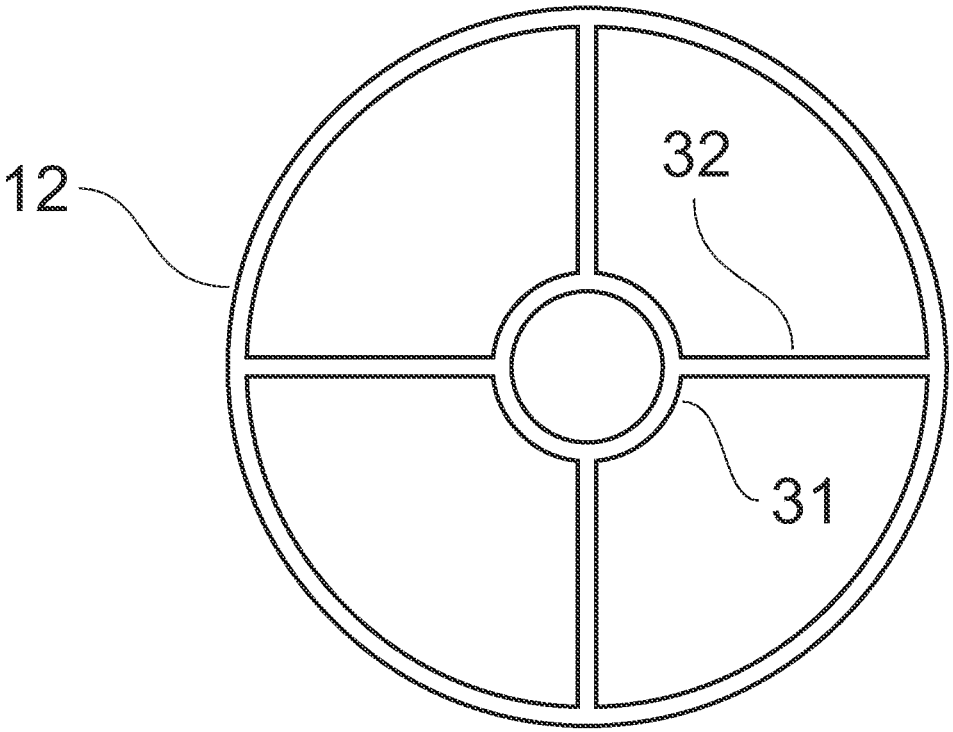
FIG. 4 (PRIOR ART)
FIG. 4 shows a plan view of the foundation shown in FIG. 3.
Figure 5:
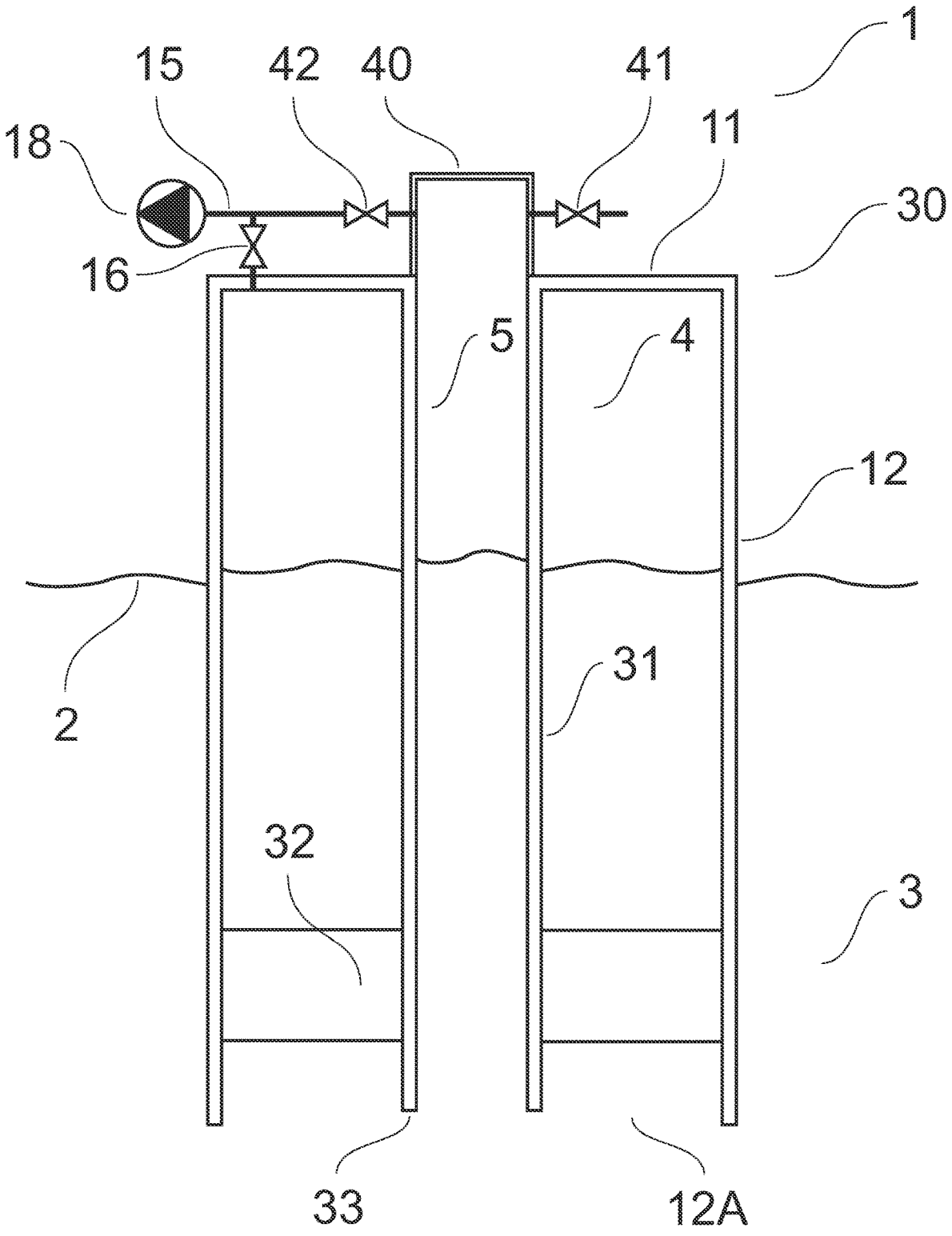
FIG. 5 shows an example embodiment of a suction anchor or well support according to the present disclosure.
Figure 6:
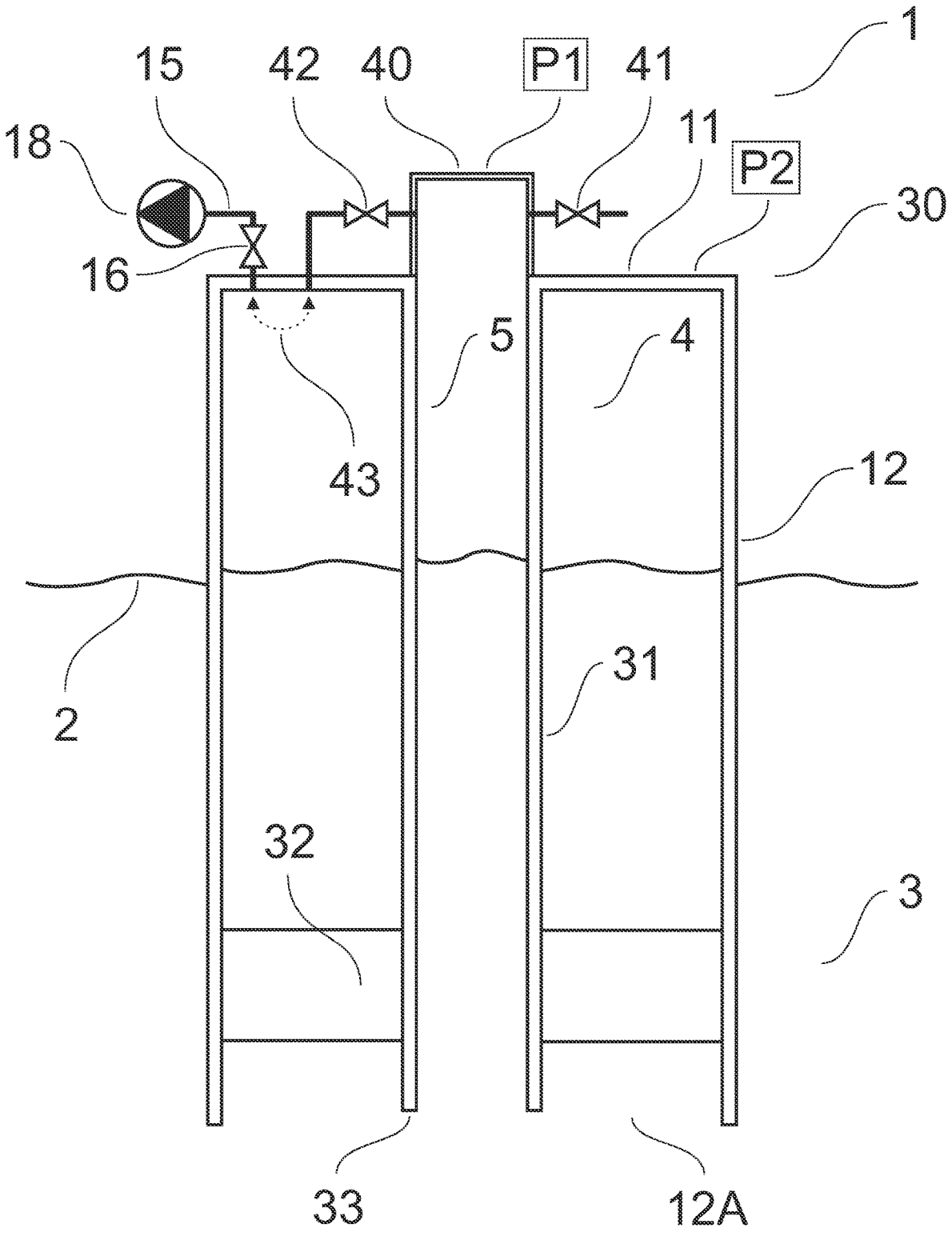
FIG. 6 shows an example embodiment of a suction anchor or well support according to the present disclosure.

FIG. 5 and FIG. 6 show example embodiments of a conductor anchor node (CAN) system 30 according to the present disclosure. To enable a successful installation of the CAN system 30 in a permeable formation 3, for example, that consists of sand or mixed sand-clay layers, it must be possible to actively influence where a water flow path is established when enclosed volumes 4 and 5 within the CAN system 30 are evacuated, e.g., by a pump 18. The present example embodiment of a CAN system 30 may comprise a skirt 12, which may have an open end 12A for insertion into formation 3 on the water bottom 2. The other end of the skirt 12 may be closed by a top 11 similar to that described with reference to FIG. 3. A conduit 31 may be nested within the interior of the skirt 12 and may form an opening through the top 11. In some embodiments, the conduit 31 may be mounted external to the skirt 12 rather than nested within the skirt 12. Furthermore, multiple conduits 31 may be mounted in or external to the skirt 12. The top 11 is coupled to the skirt 12 and the conduit 31 to sealingly close an interior volume 4 that will be filled with water during installation of the CAN system 30.

In the present example embodiment, selectively establishing a water flow path during evacuation of the interior volume 4 may be obtained by introducing a conduit cap 40 to one end of the conduit 31 to seal the inner volume 5 of conduit 31 from the surrounding water 1. The other end of the conduit 31 may be open to enable movement of the conduit 31 and the remainder of the CAN system 30 (including the skirt 12) into the formation 3 during installation.

The conduit cap 40 may comprise a cap vent valve 41 that can provide several functions. Firstly, the cap vent valve 41 may be in an open position to enable fluid flow when the CAN system 30 is lowered from an installation vessel into the surrounding water 1. The cap vent valve 41 being open allows any trapped air inside the conduit 31 to escape to the surrounding water 1. A suction line valve 16, or a vent hatch (not shown) with increased cross-section, has a similar function, namely to vent air trapped inside of the skirt 12, that is, in the interior volume 4 during the installation process. Secondly, the cap vent valve 41 may be closed to fluid flow to ensure that the inner volume 5 of the conduit 31 is fluidly isolated from the surrounding water 1 during the suction phase of installation.

The interior of the conduit cap 40 may be fluidly connected to the suction line 15 through a valve, which in the present embodiment may be an adjustable orifice valve, identified herein as a cap suction valve 42. Thus, both the interior volume 4 in the skirt 12 and the inner volume 5 in the conduit 31 may be selectively opened to the suction side of the pump 18 used to evacuate the enclosed volumes, namely, the interior volume 4 and the inner volume 5, to urge the CAN system 30 into the formation 3. The cap suction valve 42 allows selectively and variably applying suction, and therefore under-pressure, to the inner volume 5 separately and controllably from suction separately and controllably applied to the interior volume 4. By selecting a suitable amount of opening of the cap suction valve 42 it is possible to establish both possible water flow paths, the flow path (20 in FIG. 3) along the exterior of the skirt 12 and the flow path (34 in FIG. 3) along the interior of the conduit 31 at the same time.

Although the present example embodiment contemplates a single suction pump 18 connected at its inlet to the cap suction valve 42 and the suction line valve 16, and the cap suction valve 42 is described as a variable flow opening valve, the same effect, namely, controllable suction applied to the inner volume 5 and to the interior volume 4, may be obtained by any combination of fixed and variable flow opening features for the suction line valve 16 and the cap suction valve 42. It is also within the scope of this disclosure to have separate pumps (not shown) connected at their respective inlets to the suction line valve 16 and the cap suction valve 42. Such pumps (not shown) may be single speed, multiple speed or variable speed to effect the same result, namely, to cause water movement into the interior volume 4 and the inner volume 5 to traverse both flow paths (20 and 34 in FIG. 3) simultaneously.

In some embodiments, a first pressure sensor or gauge P1 may be arranged to measure pressure in the inner volume 5, and a second pressure gauge P2 may be arranged to measure pressure in the interior volume 4. The pressure sensors or gauges P1, P2 may be substituted by a differential pressure sensor arranged to measure pressure difference between the inner volume 5 and the interior volume 4. In such embodiments, any or all of the suction line valve 16, the cap suction valve 42 and one pump 18 or a second pump (not shown) may be operated to maintain a pressure in the inner volume 5 that is the same as or is within a predetermined difference of the pressure in the interior volume 4. By maintaining such pressures or pressure difference, water flow other than along the two paths (20 and 34 in FIG. 3) may be minimized. In such way, movement of the CAN system 30 into the formation 3 may be optimized in the presence of permeability in the formation 3.

Figure 1:
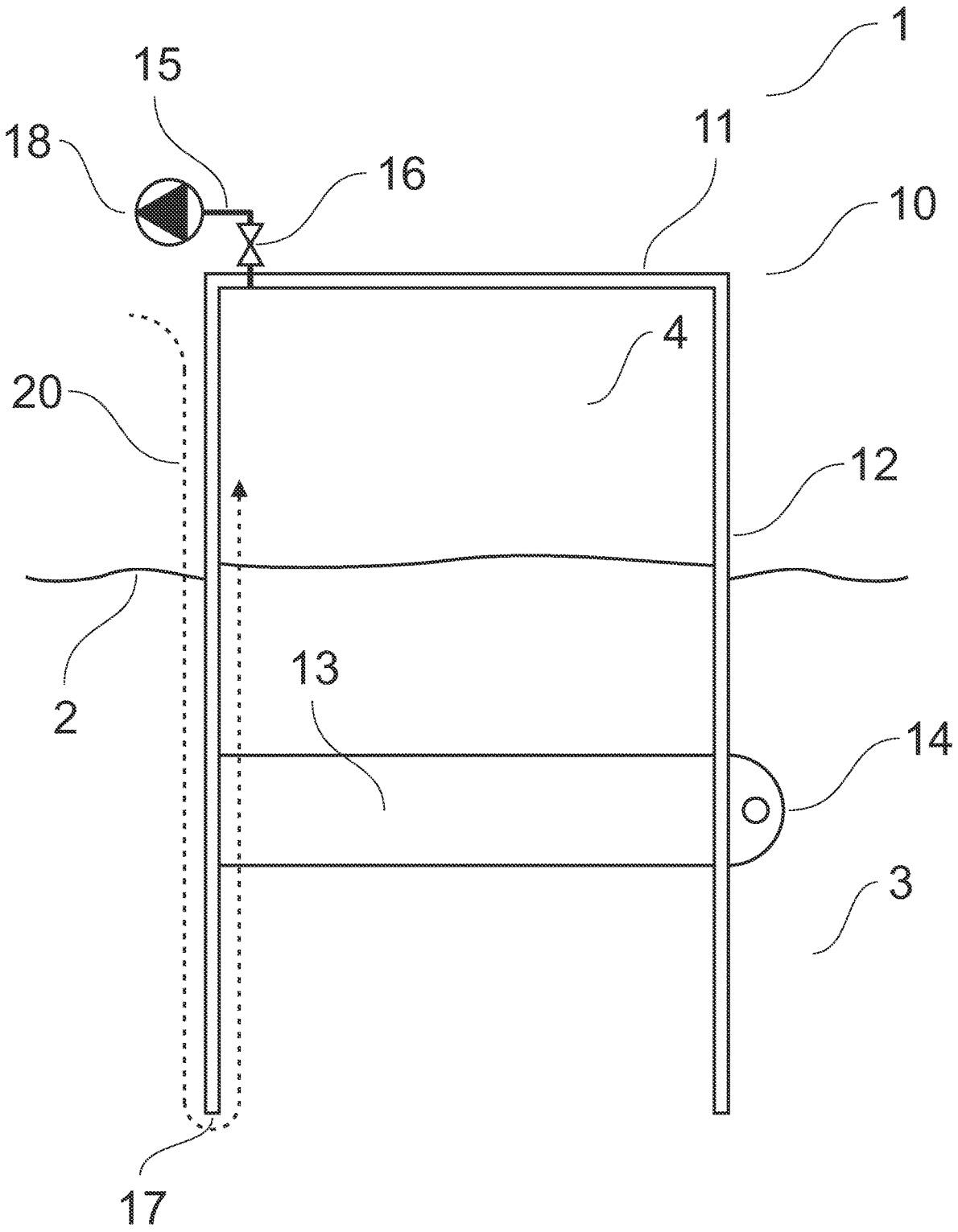
FIG. 1 (PRIOR ART)
FIG. 1 shows an elevation view of a suction anchor known in the art prior to the present disclosure.
Figure 2:
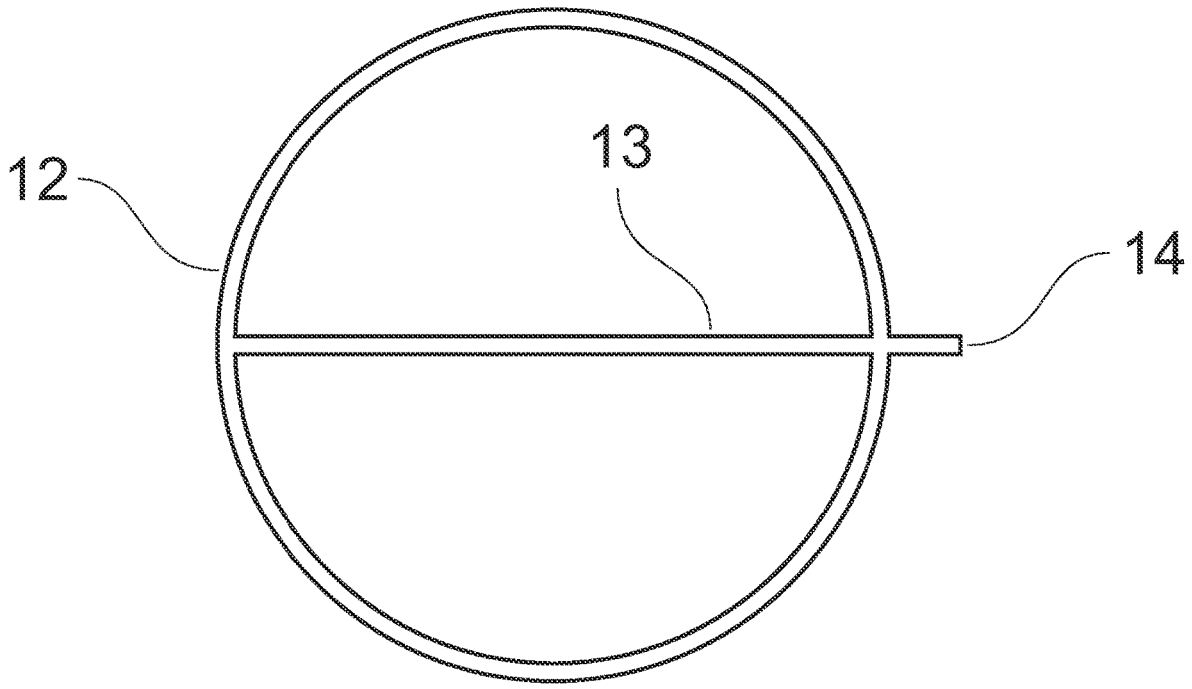
FIG. 2 (PRIOR ART)
FIG. 2 shows a plan view of the suction anchor of FIG. 1.

In some embodiments, a way to decrease the penetration resistance at the conduit tip 33 and at the lower edge of the internal member 32 is to install a water injection system (not shown) as described in the Background section with reference to FIG. 1.

An alternative arrangement, and referring specifically to FIG. 6, to establish suction in the conduit's enclosed water mass (i.e., inner volume 5) is to connect the cap suction valve 42 to the internal water mass enclosed by the skirt 12 (i.e., interior volume 4) directly. In this arrangement an internal flow path 43 is established proximate the top 11. The embodiment shown in FIG. 6 may have the advantage that the suction line 15 and the cap suction valve 42 can be designed as separate elements, while using only a single pump 18.

Figure 7:
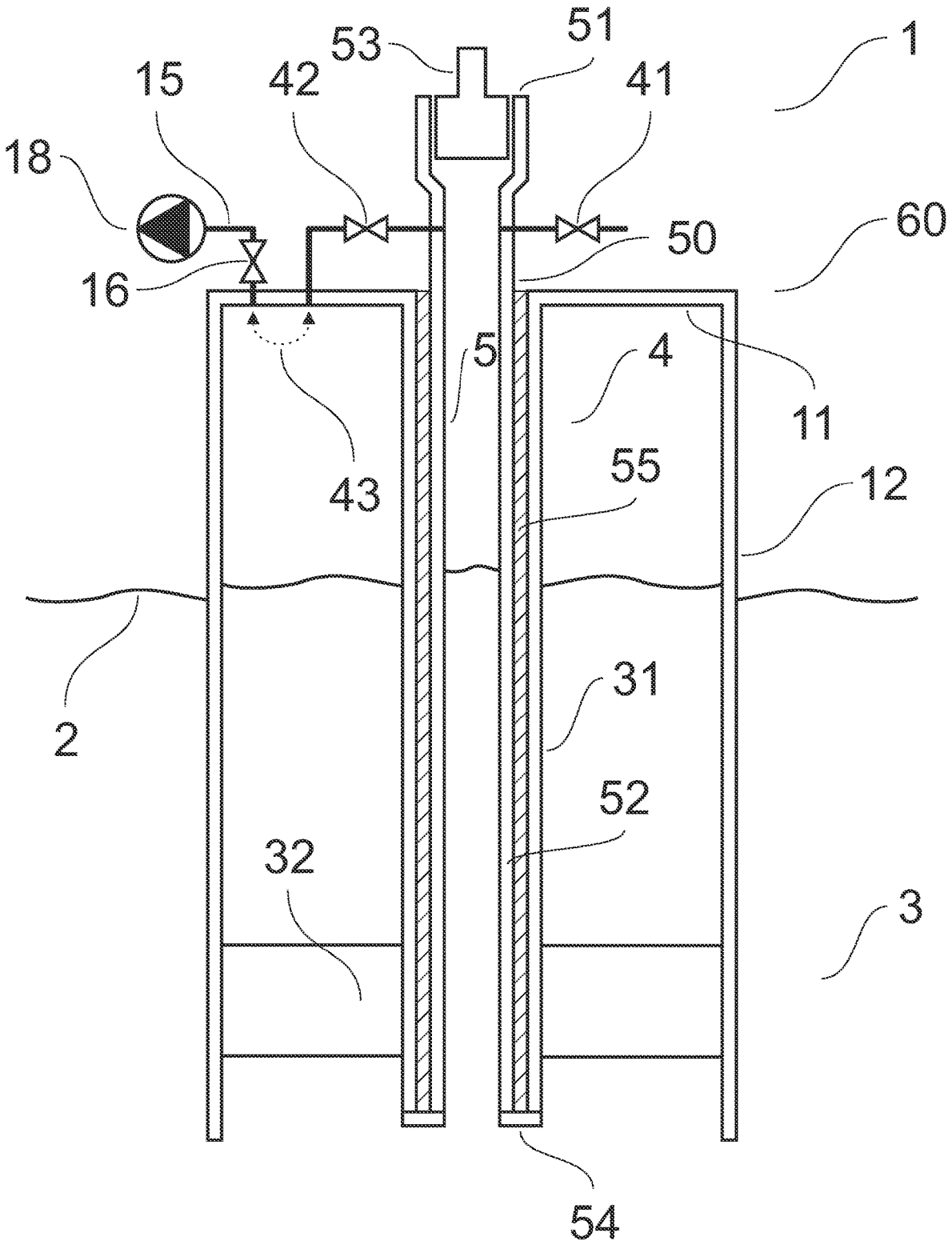
FIG. 7 shows an example embodiment of a suction anchor or well support according to the present disclosure.

Another example embodiment of a CAN system 60 according to the present disclosure is shown in FIG. 7. In this embodiment, a conductor 50, with a low pressure wellhead housing 51 and a conductor pipe 52, may be pre-assembled into the CAN system 60 by nesting the conductor 50 into the skirt 12 through the conduit 31 in a workshop or other land-based facility prior to installation of the CAN system 60 on the water bottom. Thus, the conductor 50 may be pre-installed instead of being installed in the already emplaced CAN system 60 by a drilling unit or other water-borne or water bottom supported construction device. The conductor 50 may be mounted proximate its bottom end to proximate the bottom end of the conduit 31 using a conductor anchor 54. An annular space between the outer diameter of the conductor 50 and the inner diameter of the conduit 31 may be filled with void filling material such as cement 55 or other filling medium suitable for such purpose, for example and without limitation, epoxy. The upper end of the conductor 50 may be formed into a low pressure wellhead housing 51, which is open prior to further well construction. A cap is needed to seal the conductor 50 at its upper end in order to effect suction installation of the CAN system 60 into the formation 3. Sealing may be effected by using a conductor running tool 53 sealingly engaged to the interior surface of the low pressure wellhead housing 51. In this embodiment, the cap vent valve 41 may be fluidly connected to conduit the inner volume 5 via a cement port (not shown) in the conductor 50. The cap suction valve 42 may be connected to the interior volume 5 in a similar manner.

Figure 8:
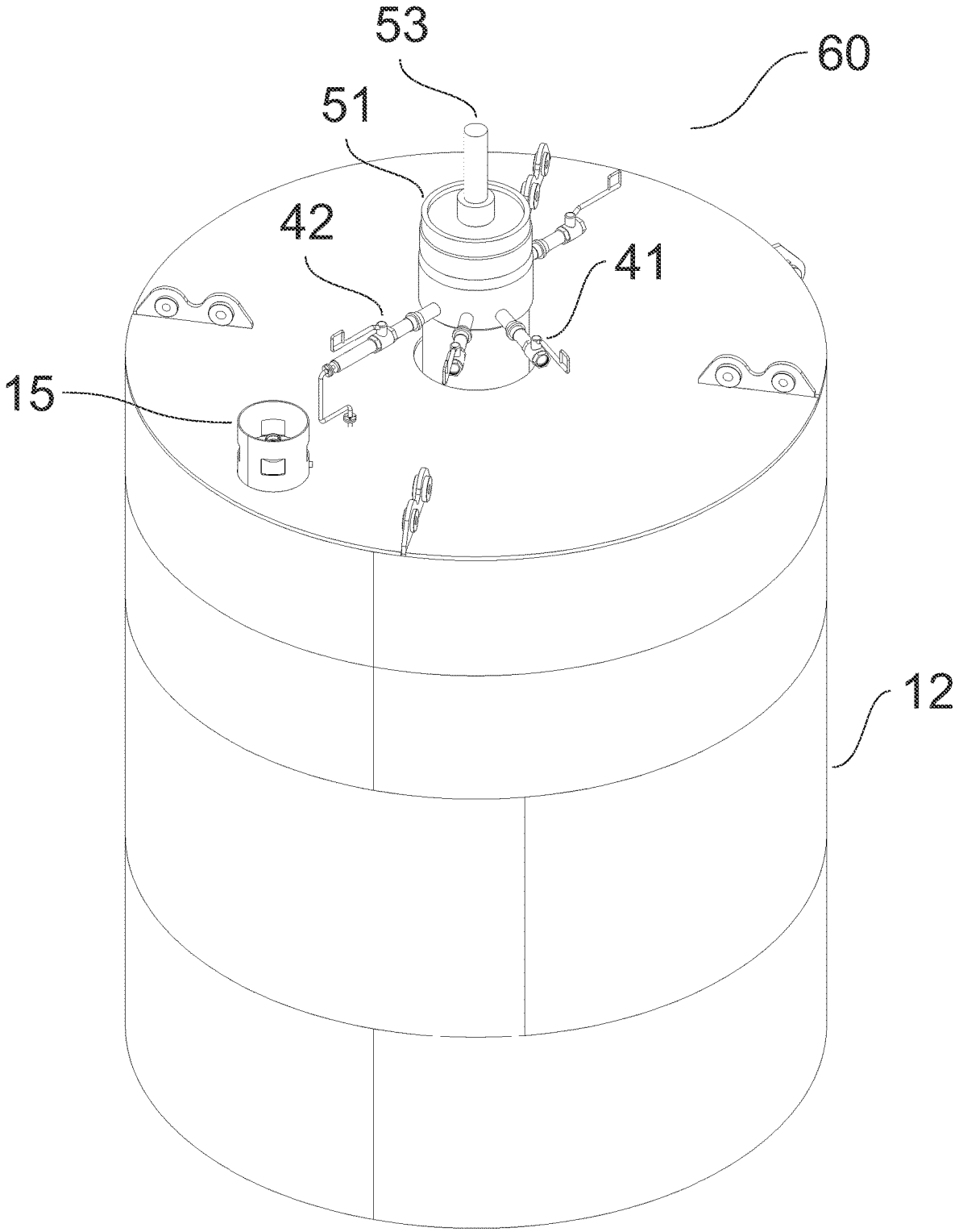
FIGS. 8 through 11 show various views of the example embodiment shown in FIG. 7.
Figure 9:
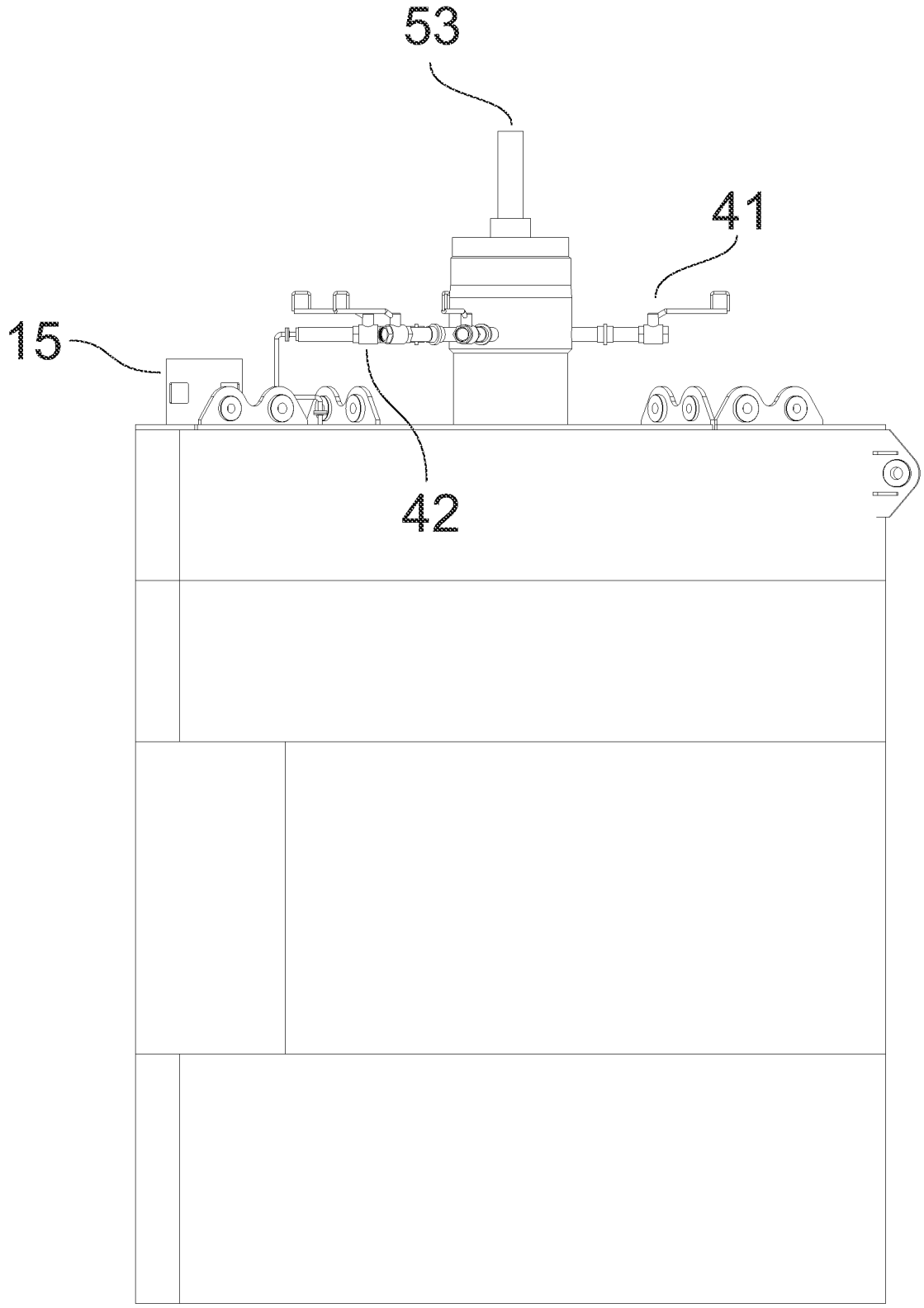
Figure 10:
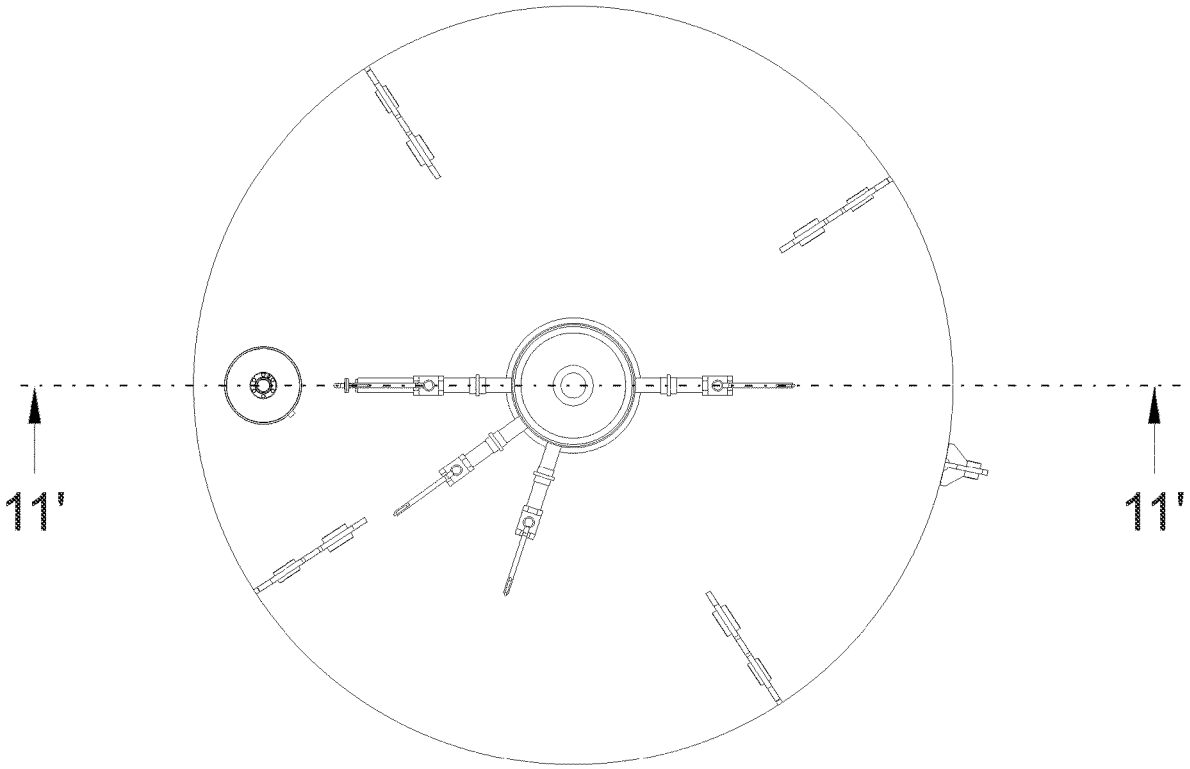
Figure 11:
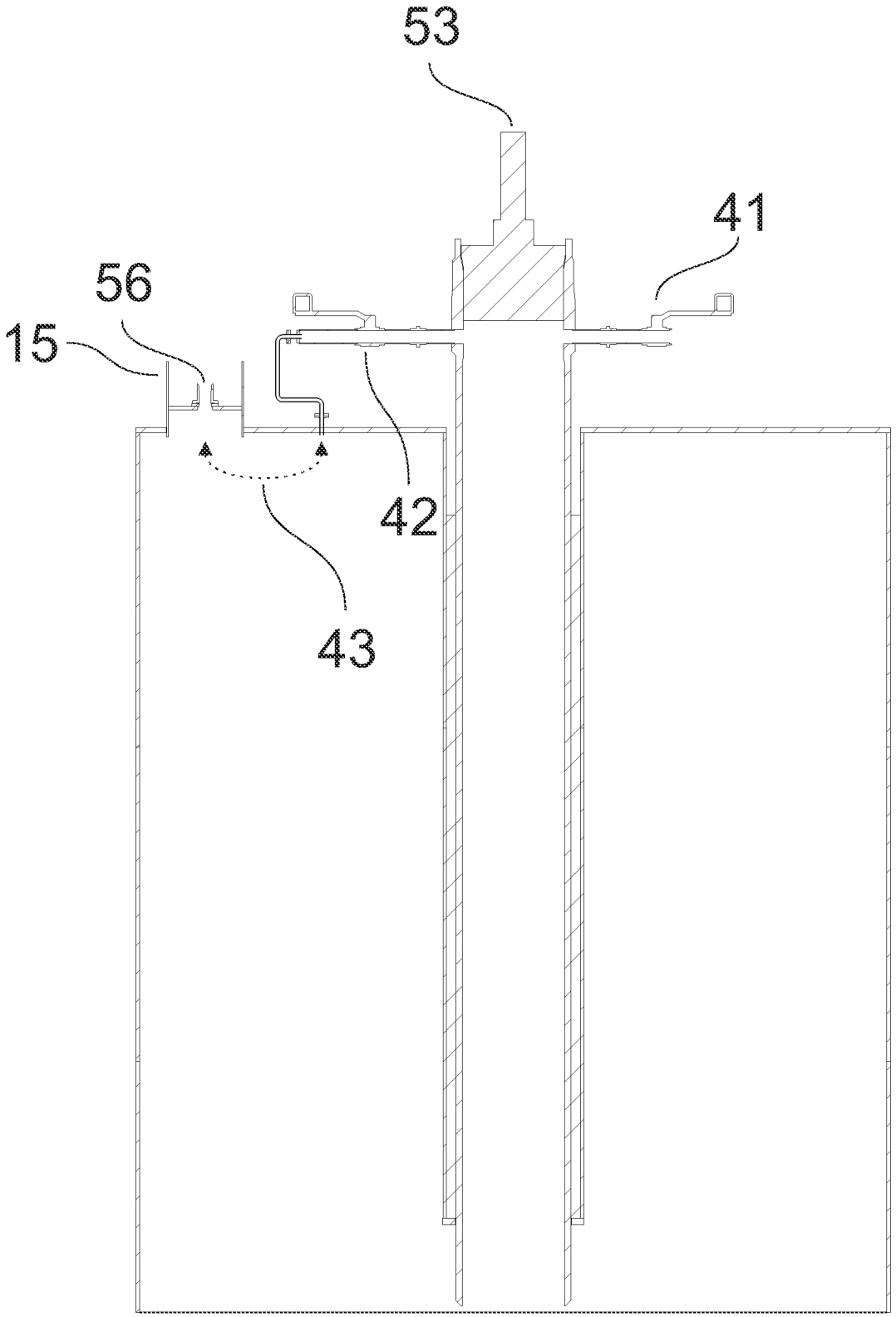

FIG. 8 shows an oblique view of the embodiment in FIG. 7 to better illustrate the relative positions of the various components with reference to the centerline of the CAN system 60. FIG. 9 shows an elevation view of the embodiment of FIG. 8. FIG. 10 shows a top view of the embodiment of FIG. 8, and FIG. 11 is a cross-section along line 11-11' of the view in FIG. 10. In this embodiment the suction line valve (16 in FIG. 6) is replaced by a receptacle 56, as shown in FIG. 11. The suction pump (not shown) may be connected by a stab that inserts into the receptacle 56 during the suction process. The closing function of suction line valve (16 in FIG. 6) may be substituted by a sealing plug (not shown) that seals the receptacle 56 pressure tight after the installation is completed.

During removal of the CAN system (30 or 60) from the formation 3 some similarities apply. In order to remove the CAN system (30 or 60) from the formation 3, to establish fluid flow paths such as at 20 and 34 (but in reverse direction as indicated in the drawings) the conduit cap 40 may be installed on the conduit 31 again. Similar to the installation process described above it may be an advantage to also apply over-pressure in the inner volume 5 and in the internal volume 4. Other elements of the system, such as the cap vent valve 41, the cap suction valve 42, internal flow path 43, etc. may be used to adjust or balance the applied over-pressure between the internal and inner volumes, 4 and 5, respectively.

In light of the principles and example embodiments described and illustrated herein, it will be recognized that the example embodiments can be modified in arrangement and detail without departing from such principles. The foregoing discussion has focused on specific embodiments, but other configurations are also contemplated. In particular, even though expressions such as in "an embodiment," or the like are used herein, these phrases are meant to generally reference embodiment possibilities, and are not intended to limit the disclosure to particular embodiment configurations. As used herein, these terms may reference the same or different embodiments that are combinable into other embodiments. As a rule, any embodiment referenced herein is freely combinable with any one or more of the other embodiments referenced herein, and any number of features of different embodiments are combinable with one another, unless indicated otherwise. Although only a few examples have been described in detail above, those skilled in the art will readily appreciate that many modifications are possible within the scope of the described examples. Accordingly, all such modifications are intended to be included within the scope of this disclosure as defined in the following claims.

What is claimed is:

1. A suction anchor, comprising:

a skirt open at one end and closed at another end to define an interior volume;

at least one conduit nested within the skirt or disposed adjacent to the skirt, the conduit open at one end and temporarily closed at another end to define an inner volume;

a suction line fluidly connected to the interior volume through a first valve;

a second valve fluidly connected between the inner volume and either the suction line or the interior volume, wherein the first valve and the second valve are operable to cause water flow along both the skirt and the at least one conduit from a body of water at respective selected rates when the interior volume and the inner volume are evacuated and the suction anchor is disposed on the bottom of a body of water; and a pressure sensor in fluid communication with the inner volume and the interior volume, the pressure sensor arranged to generate signals corresponding to a difference between fluid pressure in the inner volume and fluid pressure in the interior volume.

2. The suction anchor of claim 1 further comprising a conductor nested within the conduit, the conductor comprising a wellhead housing and a conductor pipe extending from the wellhead housing through the conduit.

3. The suction anchor of claim 2 wherein the conduit and the conductor pipe are connected at respective longitudinal ends by a conductor anchor.

4. The suction anchor of claim 2 wherein the inner volume is defined within an interior of the conductor pipe.

5. The suction anchor of claim 4 further comprising a cap comprising a conductor running tool disposed in the conductor pipe.

6. The suction anchor of claim 1 wherein the second valve is in fluid communication between the inner volume and the interior volume.

7. The suction anchor of claim 1 wherein the second valve is in fluid communication between the inner volume and the suction line.

8. The suction anchor of claim 1 wherein at least one of the first valve and the second valve has a variable orifice.

9. A method for affixing a suction anchor having at least one conduit nested in or adjacent to a skirt extending to a bottom of a body of water, the method comprising:

lowering the suction anchor so that the skirt is in contact with the bottom of the body of water;

reducing pressure in an interior volume defined within the skirt and external to the at least one conduit;

reducing pressure in an inner volume defined by an interior of the at least on conduit; and wherein the reducing pressure in the inner volume and the reducing pressure in the interior volume are performed at respective rates such that water cross flow between the interior volume and the inner volume is minimized, the reducing pressure comprising measuring a pressure in the inner volume and measuring pressure in the interior volume, and minimizing a difference between the measured pressures is minimized.

10. The method of claim 9 wherein respective rates of reducing pressure in the inner volume and the interior volume are controlled by operating at least one variable flow valve.

11. A suction anchor, comprising:

a skirt open at one end and closed at another end to define an interior volume;

a conduit nested within the skirt or disposed adjacent to the skirt, the conduit open at one end and temporarily closed at another end to define an inner volume;

means for evacuating the inner volume and the internal volume, the means for evacuating operable to cause water flow along both the skirt and the conduit from a body of water by separately controlling rates of evacuation from the inner volume and the interior volume when the suction anchor is disposed on a bottom of a body of water, the means for evacuating comprising a pressure sensor in communication with the inner volume and with the interior volume, the pressure sensor generating signals corresponding to a difference in pressure between the inner volume and the interior volume.

12. The suction anchor of claim 11 further comprising a conductor nested within the conduit, the conductor comprising a wellhead housing and a conductor pipe extending from the wellhead housing through the conduit.

13. The suction anchor of claim 12 wherein the conduit and the conductor pipe are connected at respective longitudinal ends by a conductor anchor.

14. The suction anchor of claim 12 wherein the inner volume is defined within an interior of the conductor pipe.

15. The suction anchor of claim 14 further comprising a cap comprising a conductor running tool disposed in the conductor pipe.

16. The suction anchor of claim 11 wherein the means for evacuating comprises a pump, a first valve in fluid communication between an inlet of the pump and the internal volume and second valve in fluid communication between the inner volume and the interior volume.

17. The suction anchor of claim 16 wherein the second valve is in fluid communication between the inner volume and the inlet of the pump.

18. The suction anchor of claim 16 wherein at least one of the first valve and the second valve has a variable orifice.

19. The suction anchor of claim 11 wherein the means for evacuating comprises a first pump having an inlet in fluid communication with the inner volume and a second pump having an inlet in fluid communication with the internal volume.

20. The suction anchor of claim 19 wherein at least one of the first pump and the second pump is a variable speed pump.

* * * * *